US005618119A

United States Patent [19]

Misu et al.

[11] Patent Number: 5,618,119

[45] Date of Patent: Apr. 8, 1997

[54] CASSETTE FOR PRINTED TAPE AND METHOD OF PRINTING

[75] Inventors: Susumu Misu, Kuwana; Takashi Higashi, Nagoya, both of Japan

[73] Assignee: Brother Kogyo Kabushiki Kaisha, Nagoya, Japan

[21] Appl. No.: 516,106

[22] Filed: Aug. 17, 1995

[30] Foreign Application Priority Data

Sep. 28, 1994 [JP] Japan ..... 6-233673

[51] Int. Cl.[6] ..... B41J 35/28

[52] U.S. Cl. ..... 400/208; 400/613; 400/692

[58] Field of Search ..... 400/207, 208, 400/613, 691, 692, 693, 693.1, 249, 235, 235.1

[56] References Cited

U.S. PATENT DOCUMENTS

| | | | |
|---|---|---|---|
| 4,337,001 | 6/1982 | Cappotto | 400/234 |
| 4,927,278 | 5/1990 | Kuzuya et al. | 400/208 |
| 5,203,951 | 4/1993 | Hattori et al. | 156/554 |
| 5,411,339 | 5/1995 | Bahrabadi et al. | 400/208 |
| 5,435,658 | 7/1995 | Hasegawa | 400/208 |
| 5,454,650 | 10/1995 | Yamaguchi | 400/208 |

FOREIGN PATENT DOCUMENTS

| | | | |
|---|---|---|---|
| 142108 | 5/1985 | European Pat. Off. | 400/208 |
| 4-173381 | 6/1992 | Japan . | |
| 155067 | 6/1993 | Japan | 400/208 |
| 115234 | 4/1994 | Japan | 400/208 |
| 227105 | 8/1994 | Japan | 400/208 |

*Primary Examiner*—Ren Yan

*Attorney, Agent, or Firm*—Oliff & Berridge

[57] ABSTRACT

A cassette case is removably attached into a main body of a printed tape producing apparatus. The apparatus includes a print section and a platen that is pressed against or brought out of contact with the print section, and carries out printing by passing an ink ribbon and a print tape between the print section and the platen. The cassette case housing the ink ribbon is provided with a container section into which a tape case housing the print tape is removably fitted. The cassette case and the tape case are respectively provided with a guide groove having its top opened, and it is possible to easily carry the tape to the print section by pinching the tape at the opening in the guide groove.

17 Claims, 6 Drawing Sheets

CASSETTE FOR PRINTED TAPE AND METHOD OF PRINTING

BACKGROUND OF THE INVENTION

1. Field of the Invention

This invention relates to a cassette tape removably attached to a printed tape producing apparatus comprising a print section such as a thermal head, a platen, and a tape transfer device and being arranged to print images such as characters or patterns in accordance with previously input data. More particularly, the present invention relates to a cassette tape that enables easy recombination of colors and types of print tape corresponding to the color and type of an ink ribbon housed in the cassette tape.

2. Description of the Related Art

The applicant of the present invention has put forward a printed tape producing apparatus for use with a receptor type label, or the like, as disclosed in U.S. Pat. No. 4,927,278. This apparatus is constituted such that a cassette tape can be removably attached to a cassette container of the printed tape producing apparatus, the cassette case comprising a print tape, which serves as a medium to be printed, and an ink ribbon. The cassette container is provided with a print section equipped with a thermal head, a roller-like platen that is pressed against or brought out of contact with the print section, and structure for taking up the ink ribbon. Images such as a string of characters are printed on the print tape while the tape is being pulled out of the cassette tape at an appropriate speed based on data previously input into the printed tape producing apparatus. The printed tape producing apparatus has a tape cutter for separating a printed tape to a predetermined length.

An ink ribbon and a print tape are previously incorporated into the conventional cassette tape in a fixed manner. For example, some images are printed in black on a white tape, and other images are printed in red on a white tape. In such a case, a user has to previously prepare a cassette having a desired combination of print inks and tape colors. The user has to bear a considerable expenditure in order to purchase cassette cases to accommodate several print colors and tape colors.

To solve this problem, another cassette has been disclosed in Japanese Laid-open Patent Publication No. 4-173381. For a laminate type label, a tape case houses a transparent print tape and a double-sided adhesive tape. A through hole in which an ink ribbon can be inserted into a transverse direction of the tape is formed in a bore of the tape case. The ink ribbon case is removably attached to the tape case, and the two cases can be removably attached to the printed tape producing apparatus in an integrated fashion.

However, according to the prior art technique disclosed in Japanese Laid-open Patent Publication No. 4-173381, both the ink ribbon and tape cases are sealed except portions thereof corresponding to a print section of the printed tape producing apparatus. For this reason, it is difficult for the user to take up slack in the ink ribbon or the tape. In addition, the shape of the through hole formed in the bore of the tape case, into which the ink ribbon case is fitted, is matched with the outer shape of the ink ribbon case. It is difficult to fit the tape case of a different color and the ink ribbon case of a different color again into the printed tape producing apparatus after both cases have been removed from the apparatus in order to change the combination of the tape case housing a tape of a predetermined color with the ribbon case housing an ink ribbon of a predetermined color.

For example, after the tape case has been removed from the printed tape producing apparatus while the two cases are attached to the apparatus, a tape case housing a tape of another color to be replaced is attached to the printer. During the replacement of the tape case, it is necessary to insert the tape case into the ink ribbon case such that a part of the tape exposed outside of the tape case is superimposed on a part of an ink ribbon exposed outside of the ink ribbon case in the vicinity of the print section with respect to a transverse direction of the ink ribbon. If either the ink ribbon or the tape has slight slack, it will be considerably difficult to attach the tape case to the ink ribbon case such that the ink ribbon and the tape are superimposed on each other at the print section.

This problem is similarly encountered in recombining the tape case with the ink ribbon case before the cases are attached to the printed tape producing apparatus.

SUMMARY OF THE INVENTION

The present invention is intended to solve the previously mentioned drawbacks in the prior art, and an object of this invention is to provide a cassette case and a tape case for use in producing a printed tape that permits considerably easy replacement of the tape.

According to one aspect of the present invention, this object is achieved by a cassette case removably attached to a main body of a printed tape producing apparatus, the apparatus including a print section and a platen that is pressed against or brought out of contact with the print section. Printing is carried out by passing an ink ribbon and a print tape between the print section and the platen. The cassette case housing the ink ribbon is provided with a container section to which a tape case housing the print tape is removably attached, and at least a part of a path for the tape formed in the cassette case or the tape case to transfer the tape to the print section is opened so that the tape can be accessed.

When the combination of the color of a tape with the color of an ink ribbon is changed, the tape case is removed from the cassette case housing the ink ribbon. After another tape case has been inserted into the cassette case, a tape of this replaced tape case is transferred toward the print section by picking up the tape through an opening of the path formed in the tape case and/or the cassette case. As a result, it is possible to easily superimpose the ink ribbon on the tape at an area in the vicinity of the print section as well as to bring the ink ribbon in parallel alignment with the tape.

In one preferred embodiment of the cassette case for producing a printed tape, the opening of the tape path is formed in the upper surface side of the cassette case.

In addition to the advantageous result obtained by the cassette case according to the first aspect of the present invention, even when only the tape case is replaced while the cassette tape previously given the tape case is attached to the printed tape producing apparatus, it is possible to pick up the tape through the opening formed in the tape path.

In another preferred embodiment of the cassette case for producing a printed tape, the opening of the tape path is formed in a side surface of the cassette case.

In addition to the advantageous result obtained by the cassette case according to the first aspect of the present invention, it is possible to access a wider surface of the tape in the tape path by virtue of the opening formed in the side surface, and hence, it is possible to easily feed (pull out) the tape.

In a further preferred embodiment of the cassette case for producing a printed tape, a window is formed in a part of an outer side surface of the tape case so that a tape in the tape case can be accessed.

By virtue of the window, it is possible to previously carry out the feeding of (pulling out of) the tape even when the tape case is in an independent state.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

An example embodying the present invention will now be described.

Figure 1:
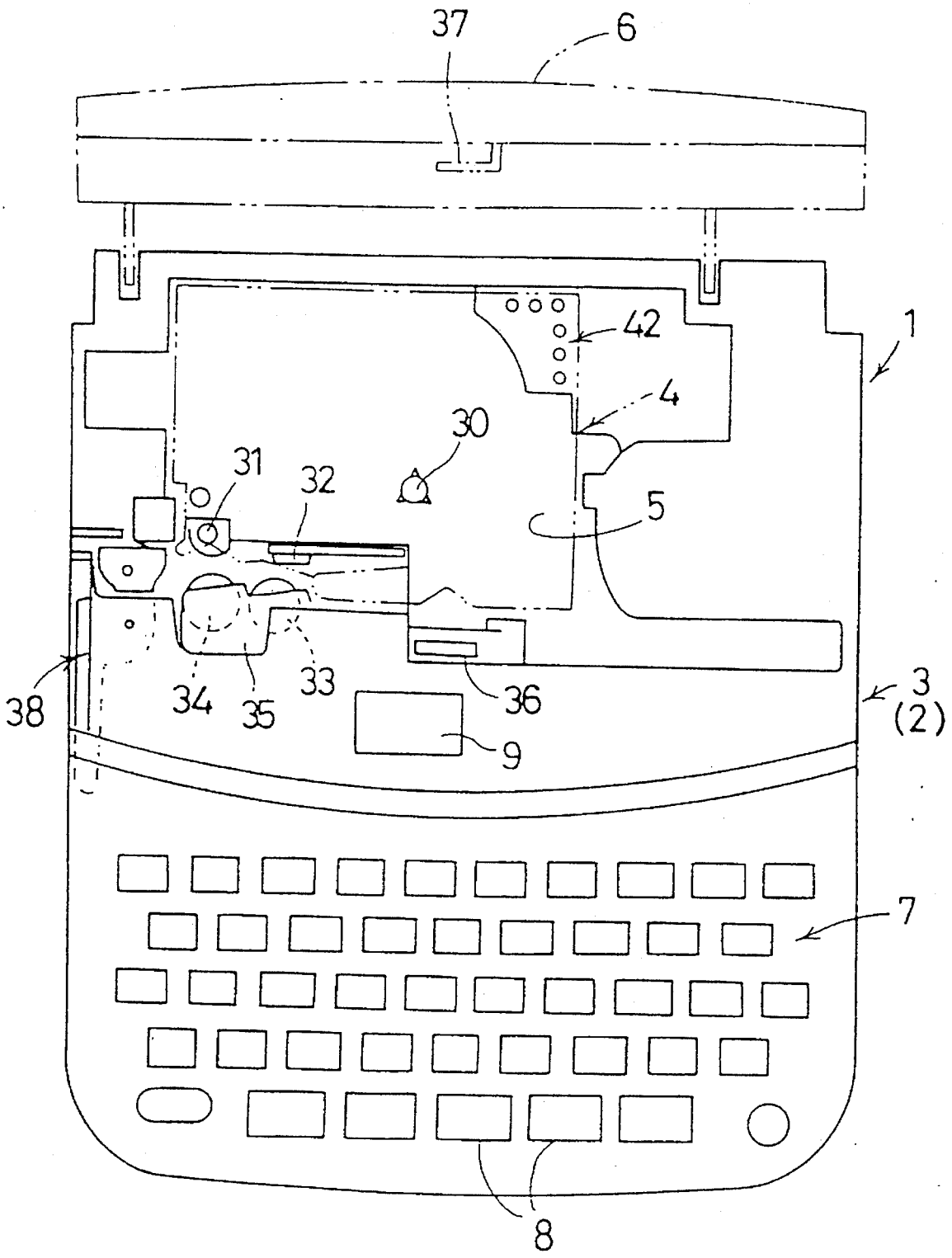
FIG. 1 is a plan view of a printed tape producing apparatus according to the present invention.

Referring to FIG. 1, a cover body 6 covers a container section 5 for removably storing the cassette case 4, which will be described later. The cover body 6 is mounted to open and close on one edge of an upper surface of an upper case 3, which fittedly engages with a lower case 2 in the printed tape producing apparatus 1. The upper and lower cases 3 and 2 and the cover body 6 are made of a synthetic resin by injection molding. A keyboard section 7 for use in inputting characters or the like, switch panels 8 for various types of operation, and a display 9 made of liquid crystal or the like for displaying input characters and operation instructions, are provided on the upper surface of the upper case 3. Mechanical machinery and a controlling microcomputer, neither illustrated, are housed in the space between the upper and lower cases 3 and 2.

The configuration of the tape transfer device and the print section will now be explained. As shown in FIG. 1, a ribbon drive camshaft 30 fitted to a bore of a ribbon take-up spool 13 in the cassette case 4, which will be described later, and a tape drive camshaft 31 fitted to a bore of a tape feed roller 14 are provided standing upright in the container section 5. Torque of a tape drive motor is transmitted to both the ribbon drive camshaft 30 and the tape drive camshaft 31 via a train of gears (not shown) arranged on a lower surface of a frame.

A print section 32 consisting of a thermal head for printing images on a tape 10 via an ink ribbon 11 and a platen holder 35 are disposed opposite to each other in the container section 5. The platen holder 35 comprises a platen 33 that is pressed against or brought out of contact with a heating element in the thermal head, and a press roller 34 that is brought into contact with the tape feed roller 14. A platen actuating lever 36 for pivotally moving the platen holder 35 is disposed in the container section 5 in a vertically pivotable manner. When the cover body 6 is closed to cover the container section 5 of the cassette case 4, the platen actuating lever 36 is pressed by a pressing section 37 projecting from an inner surface of the cover body 6. As a result, the platen 33 is pressed against the surface of the heating element of the print section 32 via the platen holder 35. At substantially at the same time, the press roller 34 is pressed against the surface of the tape feed roller 14, and printing is effected while the tape 10 is being fed from the cassette case 4 housed in the container section 5.

When the cover body 6 is opened, the platen 33 attached to the platen holder 35 is brought out of contact with the print section 32 under the resilient force of a spring (not shown), and the press roller 34 is pivotally moved out of contact with the surface of the tape feed roller 14.

A tape cutter 38 is provided on one side of the upper and lower cases 3 and 2 adjacent the container section 5 to cut the fed tape 10 in the transverse direction thereof.

With reference to FIGS. 2 to 11, the structure of the cassette case 4 and the tape case 12 will be described in detail.

Figure 2:
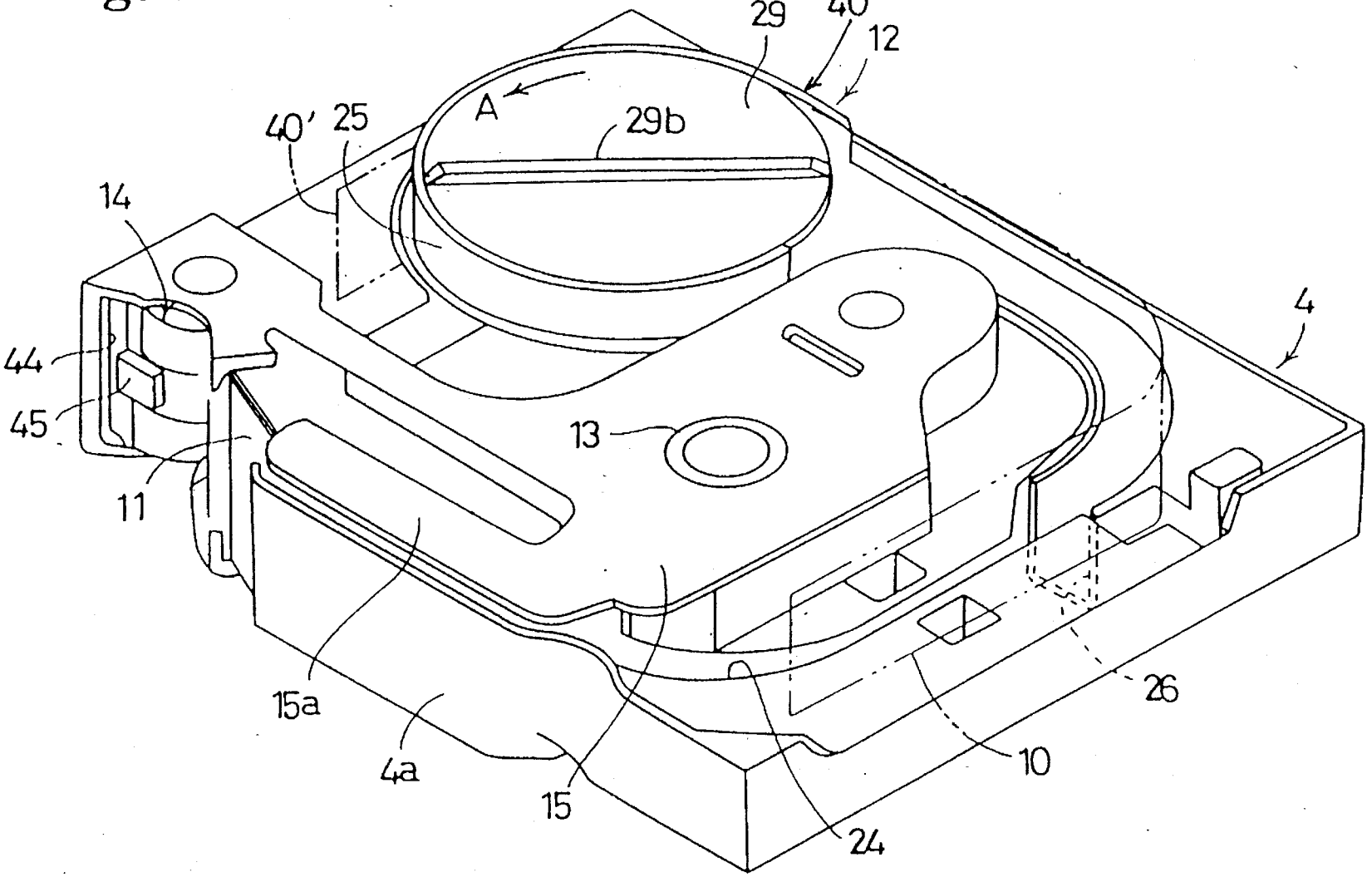
FIG. 2 is a perspective view of a cassette case housing a tape case.
Figure 3:
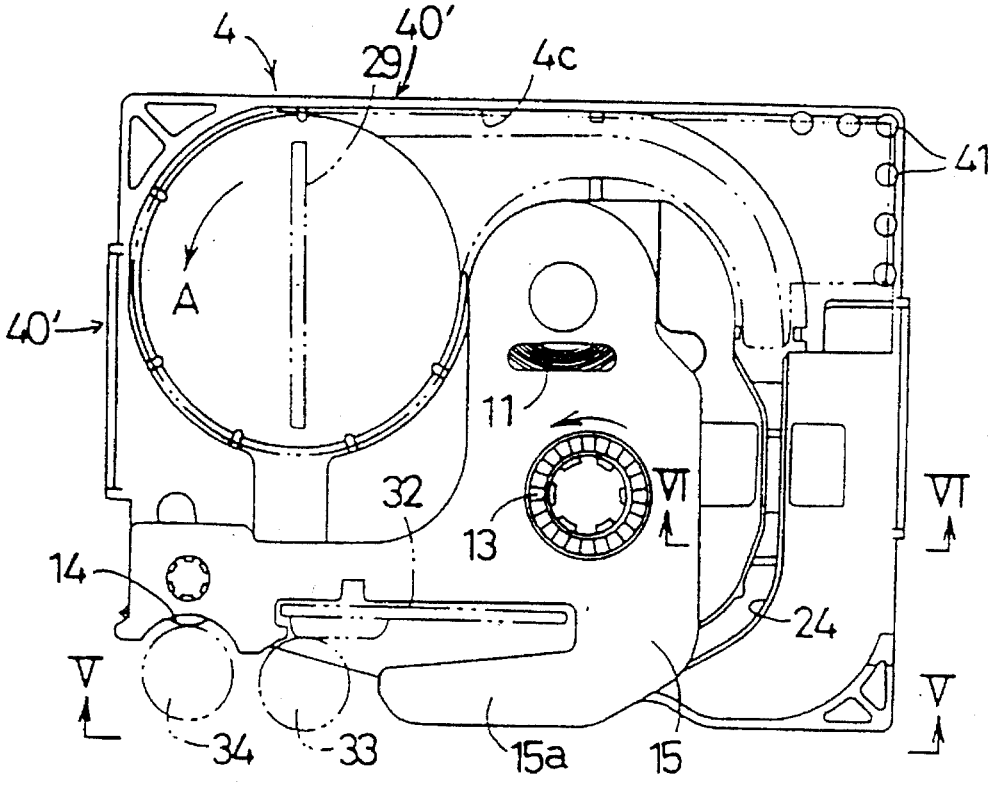
FIG. 3 is a plan view of the cassette case when the tape case is removed.
Figure 4:
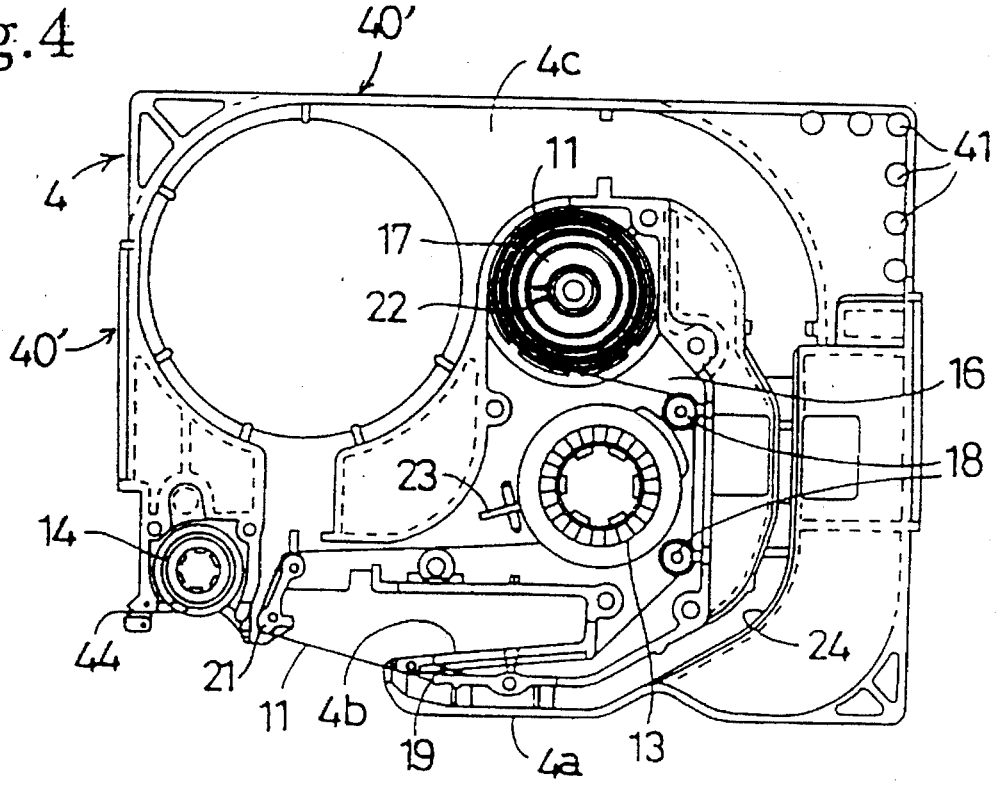
FIG. 4 is a plan view of the cassette case when a cover body is removed.

As shown in FIGS. 2 through 4, the cassette case 4 is made of a synthetic resin and houses an ink ribbon 11. The tape case 12 housing the print tape 10 can be removably attached to the cassette case 4. The upper surface of the cassette case 4 is opened. In this embodiment, images are printed on the surface of the print tape 10 facing the ink ribbon 11, and an adhesive is previously applied to the rear surface of the print tape 10. A release tape temporarily adheres to this adhesive layer.

FIG. 4 is a plan view showing the cassette tape 4 when a cover plate 15, for integrally covering upper surfaces of a housing section 16 of the ink ribbon 11 and the tape feed roller 14, is removed. The housing section 16 of the ink ribbon 11 is provided at a bore of the cassette case 4.

The ink ribbon 11 fed from an ink ribbon coiled reel 17 within the housing section 16 is discharged from an outlet 19, being formed in an outer wall **4*b* that surrounds a printing section 32, via two guide rollers 18. The thus emitted ink ribbon 11 is substantially brought into alignment closely parallel to the tape 10 at the printing section 32, and the ribbon is then taken up by the ribbon take-up spool 13 via an inlet 21 formed in the vicinity of the tape feed roller 14. The ink ribbon coiled reel 17 is provided with a back tension member 22, and the ribbon take-up spool 13 is provided with a back-stop spring member 23**.

The container **4*c* to which the tape case 12 is fitted from above is formed to surround the housing section 16 of the ink ribbon 11, and a guide groove 24 having its upper side opened is formed to communicate with the container 4*c* along the outer periphery of the housing section 16. The tape 10 pulled out of the tape case 12 along this guide groove 24 is brought into alignment closely parallel to the outer surface (a wide surface) of the ink ribbon 11 at the printing section 32. A part of the guide groove 24, serving as a path for transferring the tape 10 to the printing section 32, in the vicinity of the outlet 19 of the ink ribbon 11, is covered with and protected by the outer wall 4***a* of the cassette case 4 and an end 15*a* of the cover plate 15 to prevent the wide surface and longitudinal upper and lower edges of the tape 10 from coming into contact (from interfering) with other members such as the platen holder 35 when the cassette case 4 is removed.

As shown in FIGS. 8 through 11, the tape case 12 made of a synthetic resin is made up of a tape coil container section 25 having a substantially coil shape when viewed from above, and a guide groove section 26 surrounding a part of the outer periphery of the housing section 16 to communicate with the guide groove 24 from the tape coil container section 25. A part of the guide groove section 26, serving as a path for transferring the tape 10 from the coil container section 25, between the tape coil container section 25 and the start end of the guide groove 24 is formed to have its top opened.

A tape reel 27 to which the end of the tape 10 adheres by an adhesive tape is rotatably disposed on a spacer sheet 28 within the tape coil container section 25. Engaging projections 29*a* that removably engage with engaging slots 27*a* of the tape reel 27 are integrally formed to stand upright on the lower surface of a disk-shaped transparent tape cap 29. A finger grip 29*b* is integrally formed to stand upright on the upper surface of the tape cap 29 so that a user can pick up the grip. By virtue of the engaging projections and the finger grip, it is possible to rewind the tape 10 toward the tape coil container section 25 prior to the removal of the tape case 12 from the cassette case 4.

Figure 9:
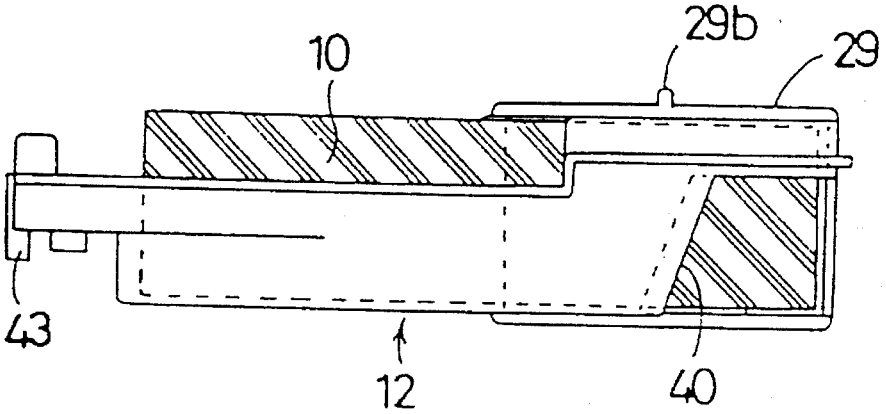
FIG. 9 is a side view of the tape case as viewed along a line IX—IX shown in FIG. 8.
Figure 10:
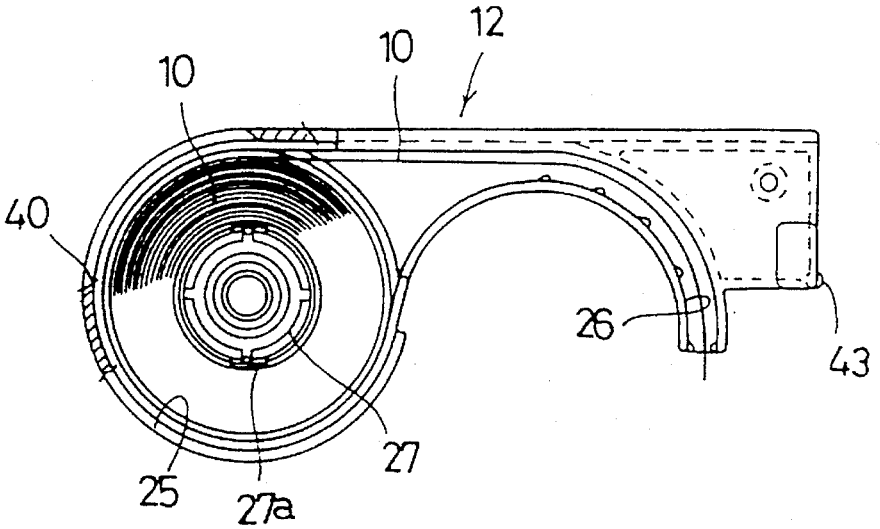
FIG. 10 is a partially broken plan view of the tape case when a tape cap is removed from the tape case.
Figure 11:
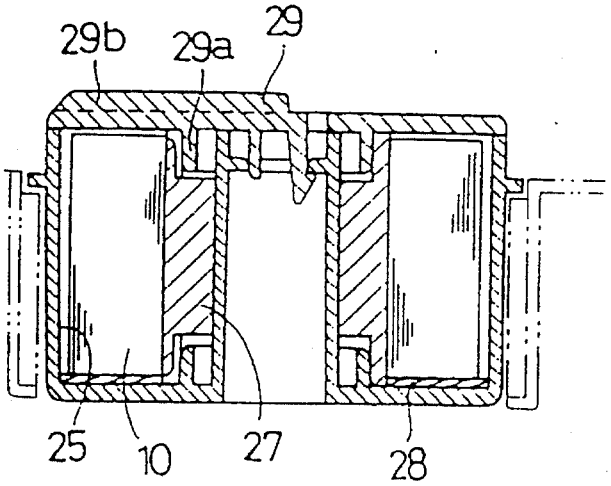
FIG. 11 is a cross-sectional view of the tape case as viewed along a line XI—XI shown in FIG. 8.

As shown in FIGS. 9 and 10, a window 40 is formed in the circumference of the tape coil container section 25. If the leading end of the tape 10 goes too far into the tape coil container section 25, it is possible for the user to easily feed out the leading end of the tape 10 by rotating a wide surface of the coiled tape manually using a finger.

In this way, since the upper side of the cassette case 4 is opened, it is possible to easily replace only the tape case 12 with a new one by opening the cover body 6 while the cassette case 4 is housed in the container section 5 of the printed tape producing apparatus 1. The upper surface of the guide groove 24 of the cassette case 4 and/or the upper surface of the guide groove 26 of the tape case 12 are opened. As a result of this, when the tape case 12 is replaced, it is easy for the user to carry the leading end of the tape 10 toward the outlet 19 of the ink ribbon 11 by picking up the tape 10 using fingers.

The cassette case 4 is provided with six detected holes 41 that are previously positioned depending on the color of the ink of the ink ribbon 11 to be inserted into this cassette case and the color and type of paper quality of the print tape 10. A detection section 42, such as a limit switch, is provided in the container section 5 detect the configuration of the holes.

In this case, a detected projection 43 projecting downwardly from the tape case 12 is fitted into the detected hole 41. Thus, it is possible to identify the color of the tape 10 in the replaced tape case 12 of the cassette case 4.

Figure 5:
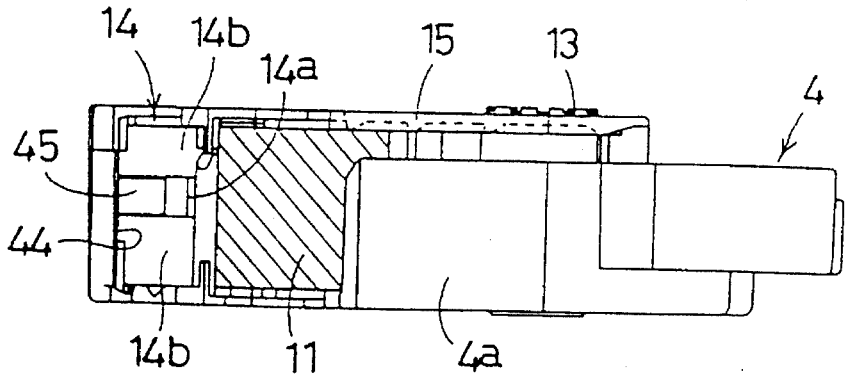
FIG. 5 is a side view as viewed along a line V—V shown in FIG. 3.
Figure 6:
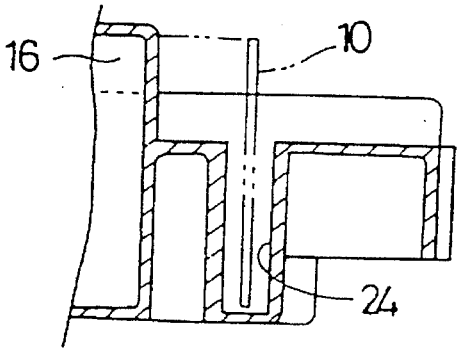
FIG. 6 is an enlarged cross-sectional view taken along a line VI—VI shown in FIG. 3.
Figure 7:
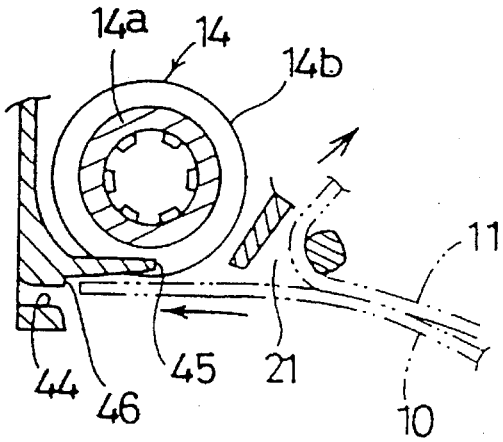
FIG. 7 is an enlarged cross-sectional view showing the principal elements of a tape feed roller.
Figure 8:
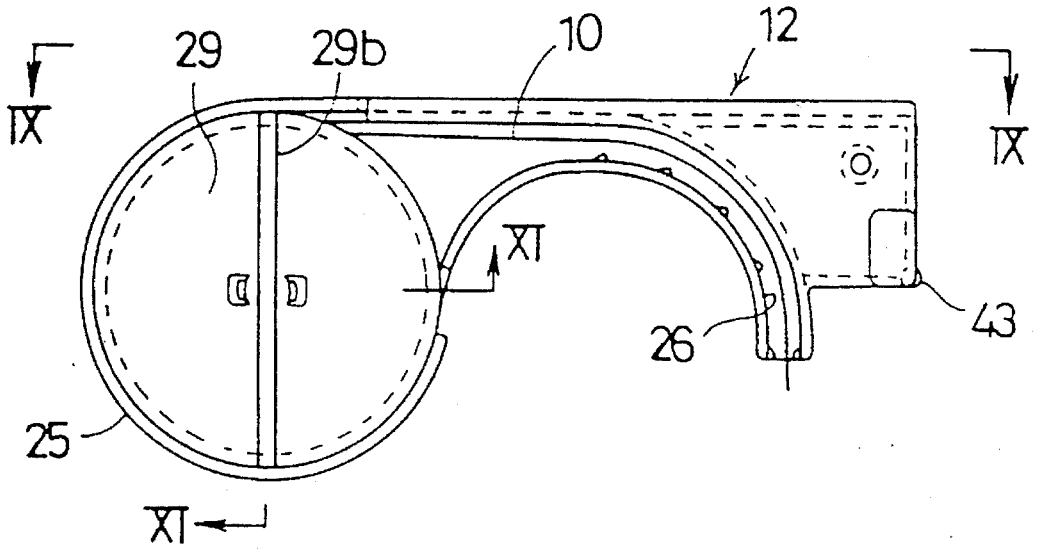
FIG. 8 is a plan view of the tape case.

Moreover, as shown in FIGS. 2, 5 and 7, a center portion 14*a* of the tape feed roller 14 has a smaller diameter, whereas upper and lower guide portions 14*b*, 14*b* have a larger diameter. A tape exit 44 is provided in the vicinity of the tape feed roller 14, and a slide 45 is provided to project from the tape exit 44 toward the center portion 14*a* having a smaller diameter. The surface of the slide 45 is set closer to an inner side (a radial inner side) compared with a level of the outer peripheral surface of the guide portion 14*a* having a larger diameter. Therefore, even if the leading end (free end) of the tape 10 is curled because of the nature of curl thereof, the leading end will be smoothly introduced to the tape exit 44. A contact step 46 is formed on the front surface of the base of the slide 45 so that the leading end of the tape 10 will come into contact with the contact step (see FIG. 7).

A mode of the use of the cassette case 4 and the tape case 12 will now be described.

Initially, the user removes slack of the red (for example) ink ribbon 11 housed in the cassette case 4 by rotating a crown, formed by the projection of the upper end of the ribbon take-up spool 13 from the cover body 15, with fingers. When the cover body 6 of the printed tape producing apparatus 1 is opened, the platen 33 and the press roller 34 of the platen holder 35 are pivotally moved to recede from the print section 32 and the tape feed roller 14. The cassette case 4 is set in the container section 5 of the printed tape producing apparatus 1, and the tape case 12 housing a yellow (for example) tape 10 is fittedly set in the case container section 4*c*. As a result, the top-opened guide groove 26 of the tape case 12 communicates with the top-opened guide groove 24 of the cassette case 4.

In this case, unless the leading edge of the tape 10 is drawn to the guide groove 26 of the tape case 12, the leading edge of the tape 10 should be positioned at the guide groove 26 by inserting a finger into the window 40 and rotating the wide surface of the tape 10 in the tape take-up container 25 in a pushing manner.

The user pinches the leading edge of the tape 10, and the leading edge is fed to the guide groove 24 from the guide groove 26. As a result of repetition of the feeding of the tape 10 at the guide groove 24, the leading edge of the tape 10 is aligned along the outer surface of the ink ribbon 11 at the outlet 19 and carried toward the tape feed roller 14 after having passed through the space between the print section 32 and the platen 33. Even when the leading edge (free end) of the tape 10 is curled because of the nature of curl thereof at the tape feed roller 14, the leading edge is smoothly guided to the point before the tape exit 44 along the surface of the smooth slide 45. In this case, since the leading edge of the tape 10 comes into contact with the contact step 46 formed on the front surface of the base of the slide 45, the position of the leading edge of the tape 10 pulled out of the cassette case 4 is restricted, whereby the leading edge is positioned.

As mentioned above, since the upper surface of the cassette case 4 is opened, it is possible to easily replace only the tape case 12 by opening the cover body 6 while the cassette case 4 is housed in the container section 5 of the printed tape producing apparatus 1. In addition, since the upper surface of the guide groove 24 of the cassette case 4 and/or the upper surface of the guide groove 26 of the tape case 12 are opened, it is easy for the user to carry the leading edge of the tape 10 to the outlet 19 of the ink ribbon 11 and the tape exit 44 by pinching the tape 10 at the guide groove 24 and/or the guide groove 26 while the tape case 12 is fitted in the cassette case 4, when the tape case 12 has been replaced.

Thus, the setting of the cassette case 4 and the tape case 12 and the positioning and setting of the tape 10 are completed.

Subsequently, after the cover body 6 of the printed tape producing apparatus 1 has been closed, the platen holder 35 is moved into the container section 5 by pivotally moving the platen actuating lever 36. The platen 33 presses the tape 10 and the ink ribbon 11 against the print section 32, and the press roller 34 presses the leading edge of the tape 10 against the guide portions 14*b* of the tape feed roller 14. At this time, the curled portion of the tape 10 is deformed by the contact step 46, as a result of which the leading edge of the tape 10 becomes possible to advance forwardly to the tape exit 44.

The user then turns on the power of the printed tape producing apparatus 1, and text letters to be printed are entered by the operation of keys on the keyboard 7 while viewing an indication appearing on the display 9 such as liquid crystal. Upon completion of the input operation, a print menu appears on the display 9 by pressing a print key (not shown).

An explanation will now be given of the case where an arbitrary letter (or arbitrary letters) of the text letters is printed on one type of tape 10 (the yellow tape 10 in the embodiment) using the red ink ribbon but the other letters are printed using the black ink ribbon 11.

To execute printing in different colors, a multi-color print mode is selected from a print menu, and the input text sentence is again displayed on the display 9. To specify a part of letters to be initially printed, a cursor is moved right and left. The cursor is positioned on the first part of a letter (or a string of letters) not to be printed from among the string of letters appeared on the display 9, and a non-printing selection instruction switch (for example, an upward-oriented arrow key ↑) is pressed. Then, the designated letter disappears from the display 9, and the space of the letter is left blank. As a result of the repetition of the operations, it is possible to specify a plurality of letters that are not initially printed. The cursor is moved and set to a designated location at the end of the text sentence indicating that the user is finished specifying letters, and a print instruction key is pressed. A first printing operation is then started. Although the letters not to be printed remain blank during this printing operation, the other letters (or the string of the other letters) are printed in red.

Upon completion of the printing operation, a message reading "Set a tape to the printer" appears on the display 9. When the user opens the cover body 6, a cover switch (not shown) is actuated. As a result of this, the platen holder 35 recedes from the print section 32, and the power of the printed tape producing apparatus 1 is turned off. Therefore, the display 9 also disappears.

Subsequently, when the user rotates a finger grip 29*b* of the tape case 12 in the direction designated by an arrow A as shown in FIG. 3, the tape reel 27 is rotated in a counter-clockwise direction via the tape cap 29. The leading edge of the rewound tape 10 is separated from the print section 32, and the leading edge is pulled back to the guide groove 26 through the guide groove 24 after having passed the outlet 19 of the cassette case 4.

When the cassette case 4 is removed from the container section 5, it is possible to remove the tape case 12 from the printed tape producing apparatus 1 together with the cassette case 4. To change a print color, the tape case 12 housing the yellow tape 10 is disengaged from the cassette case 4 housing a red ink ribbon. Another cassette case 4 housing a black ink ribbon 11 is set to the container section 5 of the printed tape producing apparatus 1. In this case, the removal of slack of the ink ribbon 11 of this cassette case 4 is carried out in the same manner as previously mentioned. The tape case 12 having the yellow tape 10, which was subjected to the first printing, is fitted into the container section 5 of the thus set cassette case 4. The tape 10 is pinched in the same manner as previously mentioned, and it is fed to the print section 32 and the tape feed roller 14 from the guide groove 24. Even in this case, when the cassette is set such that the leading edge of the tape 10 comes into contact with the contact step 46, it is possible to accurately print the letters that were not printed in the first printing operation in correct positions in the second printing operation.

After the cover body 6 is closed, the cover switch is actuated, and the power is turned on. As a result, the previously mentioned message "Set a tape to the printer" again appears on the display 9. Since the setting of the tape case 12 has already been completed, a return key is pressed. Then, a message reading "Continue a multi-color print mode (Y/N)" appears on the display 9. If the multi-color print is to be continued, the Y key is pressed. Upon depression of the Y key, the disappeared letters that were not printed in the first (or the previous) printing operation again appear on the display 9. Meanwhile, the letters previously printed are displayed by a black symbol (■).

When all of the letters not printed in the previous (first) printing operation are printed, the cursor is moved to a designated location at the end of the text sentence indicating that the user is finished specifying letters, and the print instruction key is pressed. As a result of this, the second printing operation is started, and the letters are printed in black.

When only a part of the string of letters that were not printed in the first printing operation is to be printed in black, letters not to be printed are specified in the same manner as in the first printing operation. Then, a second printing operation is executed using the print instruction key.

In this way, it is possible to print letters in different colors on the tape 10 of one color.

When the letters, having been printed in the previous printing operation (or the printing operation before the previous printing operation) and being shown by the symbol (■) on the display 9, are decorated (for example, when the letters are outlined to look three-dimensional, or when letters to be decorated are framed using an ink ribbon of a second color), the cursor is moved to the positions designated by the symbol (■), and an outline designation key is pressed. Thereafter, the print instruction key is pressed, whereby predetermined outlined letters can be prepared.

In this way, when the printing operation of all the text is completed after the repetition of the printing operations, the message "Continue a multi-color print mode ? (Y/N)" appears. When the N key is pressed, the printing operation is terminated. However, when the Y key is pressed, the message "Set a tape to the printer." appears. The modification of the designation of letters and the printing operation of letters that were changed in color are continued by the repetition of the previously mentioned procedures.

Thus, if a plurality of cassette cases 4, each housing the ink ribbon 11 of a different color, and the tape cases 12, each housing the tape 10 of a different color, are previously prepared, the colors of the tape 10 can be freely combined with the colors of the ink. Accordingly, it becomes possible to select a wide variety of combinations of the colors of the tape 10 with the colors of the ink by the use of only the small number of types of cassette cases 4 and tape cases 12.

In the prior art, once the tape case 12 is removed from the cassette case 4, another tape case 12 is inserted into the cassette case 4. Thereafter, the tape 10 in the tape case 12 is pulled such that the tape 10 is superimposed on the ink ribbon 11 in the vicinity of the area between the outlet 19 and the print section 32. Such operation is realized only by pinching the tape 10 at the top-opened guide groove 26 of the tape case 12 and/or the top-opened guide groove 24 of the cassette case 4, and by carrying the tape 10 toward the outlet 19 and the print section 32.

In other words, the ink ribbon 11 is already positioned to advance to the print section 32 via the outlet 19 within the cassette case 4. If the tape case is housed in the cassette tape such that a part of the tape 10 already being exposed through the tape case at the print section with respect to the ink ribbon 11 is moved in a transverse direction of the ink ribbon and such that the exposed part is superimposed on the ink ribbon, the longitudinal edges of the tape 10 and the ink ribbon 11 will interfere with each other. As a result of this, the edges of the tape 10 or the ink ribbon 11 will be twisted, or the ink ribbon 11 made of a material having a poor strength will be damaged or cut. Contrary to this, when the tape 10, which is pulled out of the tape case 12 fitted in the cassette case 4, is moved in a longitudinal direction (a transfer direction) of the tape 10, it will be possible to bring the tape 10 into parallel alignment with the ink ribbon 11 while the wide surfaces of the tape 10 and the ribbon 11 stand opposite each other. Therefore, it is possible to easily prevent damage to the tape 10 or the ink ribbon 11 or an alignment failure between the tape 10 and the ink ribbon 11.

So long as either the guide groove 24 serving as the transfer path of the tape 10, or the guide groove 26 of the tape case 12 serving as the transfer path of the tape 10, has its top opened in the upper surface of the cassette case 4, it will be possible to easily draw the tape 10 toward the print section 32 using fingers while the cover body 6 is opened, even when the cassette case 4 to which the tape case 12 is previously set is housed in the container section 5.

Alternatively, the guide groove 24 and the guide groove 26 may have their bottoms opened in the lower surface of the cassette case 4. Also, the guide groove 24 and the guide groove 26 may have their lateral surfaces opened in the lateral surface of the cassette case 4. A finger is brought into contact with the lateral surface of the cassette tape 10 in these transfer paths, and the tape 10 is fed toward the print section 32. In this case, a separate cover body may be removably attached to the upper surface side of the cassette case 4 to include the upper surface of the tape case 12 and to cover the entire cassette.

The window 40 opened in the outer peripheral surface of the coil container section 25 of the tape case 12 may be positioned to face an operation hole 40' drilled or cut in the side surface of the cassette case 4. In this arrangement, the tape 10 may be fed by inserting a finger into the window 40 from the outside of the cassette case 4.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments that fall within the true scope of the invention.

What is claimed is:

1. A cassette case housing an ink ribbon and being removably attached into a main body of a printed tape producing apparatus, the apparatus including a print section and a platen, said cassette case comprising:

a tape case container section to which a tape case housing a print tape is removably attached;

a guide groove through which the print tape is guided when the tape case is attached therein, the tape case including a guide groove section linking with the guide groove of the cassette case, the guide groove and the guide groove section defining a tape path for the print tape, wherein at least a part of the tape path for the print tape is open so that the print tape can be accessed from outside.

2. The cassette case as defined in claim 1, wherein the opening of the tape path is formed in an upper surface of said cassette case.

3. The cassette case as defined in claim 2, wherein a window is formed in a part of an outer peripheral side surface of said tape case so that the print tape in said tape case can be accessed from outside.

4. The cassette case as defined in claim 3, wherein a second window is formed in a side surface of said cassette case corresponding to the window in the tape case.

5. The cassette case as defined in claim 1, further comprising a rewinding member rotatably coupled to said tape case, said rewinding member engaging said print tape enabling rewinding of said print tape.

6. The cassette case as defined in claim 5, wherein said rewinding member comprises a grip formed on a surface of said rewinding member.

7. The cassette case as defined in claim 5, further comprising a contact step serving as a print tape reference point for printing.

8. The cassette case as defined in claim 1, further comprising a plurality of detected holes positioned corresponding to at least one of a color of the ink ribbon, a color of the print tape, and a type of the print tape.

9. The cassette case as defined in claim 1, further comprising a tape feed roller for feeding the print tape, said tape feed roller including a central portion having a first diameter and outer guide portions having a second diameter larger than said first diameter.

10. The cassette case as defined in claim 9, further comprising a slide disposed in the vicinity of a tape exit, said slide guiding said print tape toward said tape exit.

11. The cassette case as defined in claim 10, further comprising a contact step disposed adjacent said slide, said contact step serving as a print tape reference point for printing.

12. The cassette case as defined in claim 1, wherein said part of the tape path for the print tape is an open top of said guide groove of said cassette case communicating with an open top of said guide groove section of said tape case.

13. A cassette case housing an ink ribbon and being removably attached into a main body of a printed tape producing apparatus, said apparatus including a print section and a platen, said cassette case comprising:

a tape case container section to which a tape case housing a print tape is removably attached;

means for enabling the print tape to be accessed from outside the cassette case; and a tape feed roller for feeding the print tape, said tape feed roller including a central portion having a first diameter and outer guide portions having a second diameter larger than said first diameter.

14. The cassette case as defined in claim 13, wherein said enabling means comprises at least a part of a path for the print tape formed in said cassette case or said tape case to transfer the print tape to said print section being opened.

15. The cassette case as defined in claim 13, wherein said enabling means comprises a window formed in a part of an outer peripheral side surface of said tape case.

16. The cassette case as defined in claim 13, wherein said enabling means further comprises an opening formed in a side surface of said cassette case.

17. The cassette case as defined in claim 13, further comprising a slide disposed in the vicinity of a tape exit, said slide guiding said print tape toward said tape exit.

* * * * *